US011499556B2

(12) United States Patent
Saxod et al.

(10) Patent No.: US 11,499,556 B2
(45) Date of Patent: Nov. 15, 2022

(54) DRY VACUUM PUMP WITH A PRESSURE VARIATION REDUCING EXPANSION DEVICE BETWEEN A PUMPING SIDE VOLUME AND AN OIL SUMP

(71) Applicant: PFEIFFER VACUUM, Annecy (FR)

(72) Inventors: Laurent Saxod, Les Marches (FR); Patrick Pilotti, Annecy (FR)

(73) Assignee: PFEIFFER VACUUM, Annecy (FR)

( * ) Notice: Subject to any disclaimer, the term of this patent is extended or adjusted under 35 U.S.C. 154(b) by 173 days.

(21) Appl. No.: 17/044,615

(22) PCT Filed: Mar. 27, 2019

(86) PCT No.: PCT/EP2019/057792
§ 371 (c)(1),
(2) Date: Oct. 1, 2020

(87) PCT Pub. No.: WO2019/192913
PCT Pub. Date: Oct. 10, 2019

(65) Prior Publication Data

US 2021/0108638 A1 Apr. 15, 2021

(30) Foreign Application Priority Data

Apr. 5, 2018 (FR) ..... 18 52940

(51) Int. Cl.

| | |
|---|---|
| ***F04C 25/02*** | (2006.01) |
| ***F04C 23/00*** | (2006.01) |
| ***F04C 18/12*** | (2006.01) |
| ***F04C 27/00*** | (2006.01) |
| ***F04C 29/02*** | (2006.01) |

(52) U.S. Cl.
CPC ..... *F04C 25/02* (2013.01); *F04C 23/001* (2013.01); *F04C 18/126* (2013.01); *F04C 27/009* (2013.01);
(Continued)

(58) Field of Classification Search
CPC ..... F04C 25/02; F04C 23/001; F04C 18/126; F04C 27/009; F04C 29/02; F04C 2270/21; F04C 2220/12; F04C 2240/809
See application file for complete search history.

(56) References Cited

U.S. PATENT DOCUMENTS

2003/0007881 A1 1/2003 Yamamoto et al.
2010/0034682 A1 2/2010 Spinnler
(Continued)

FOREIGN PATENT DOCUMENTS

CN 101652569 A 2/2010
DE 20 2015 007 606 U1 3/2017
(Continued)

OTHER PUBLICATIONS

Combined Chinese Office Action and Search Report dated Mar. 29, 2022 in Chinese Patent Application No. 201980021782.8 (with English translation), 9 pages.
(Continued)

*Primary Examiner* — Mary Davis
(74) *Attorney, Agent, or Firm* — Oblon, McClelland, Maier & Neustadt, L.L.P.

(57) ABSTRACT

A dry vacuum pump includes: at least one oil sump; at least one pumping stage; two rotary shafts respectively supporting at least one rotor extending into the at least one pumping stage, the rotors being configured to rotate in a synchronized manner in the reverse direction in order to convey a gas to be pumped between an intake and an outlet of the vacuum pump, the shafts being supported by bearings lubricated by a lubricant contained in the at least one oil sump; at least one lubricant sealing device interposed between the at least one oil sump and a pumping stage at the shaft passage; and at
(Continued)

least one expansion device configured to reduce the pressure variations between a pumping side volume and the at least one oil sump.

11 Claims, 5 Drawing Sheets

(52) U.S. Cl.
CPC ..... *F04C 29/02* (2013.01); *F04C 2220/12* (2013.01); *F04C 2240/809* (2013.01); *F04C 2270/21* (2013.01)

(56) References Cited

U.S. PATENT DOCUMENTS

| | | | |
|---|---|---|---|
| 2011/0135528 | A1 | 6/2011 | Amano |
| 2012/0251368 | A1 | 10/2012 | Stephens et al. |
| 2018/0340535 | A1 | 11/2018 | Birch et al. |

FOREIGN PATENT DOCUMENTS

| | | | |
|---|---|---|---|
| EP | 1 273 801 | A2 | 1/2003 |
| EP | 2 314 874 | A1 | 4/2011 |
| JP | 2003-21088 | A | 1/2003 |
| WO | WO 2011/077105 | A2 | 6/2011 |

OTHER PUBLICATIONS

Combined Taiwanese Office Action and Search Report dated May 27, 2022 in Taiwanese Patent Application No. 108111512 (with English translation), 13 pages.

International Search report dated Jun. 4, 2019 in PCT/EP2019/057792 filed Mar. 27, 2019, 3 pages.

Taiwanese Office Action issued in Taiwanese Patent Application No. 108111512 dated Aug. 23, 2022 (w/ English translation).

Fig.1
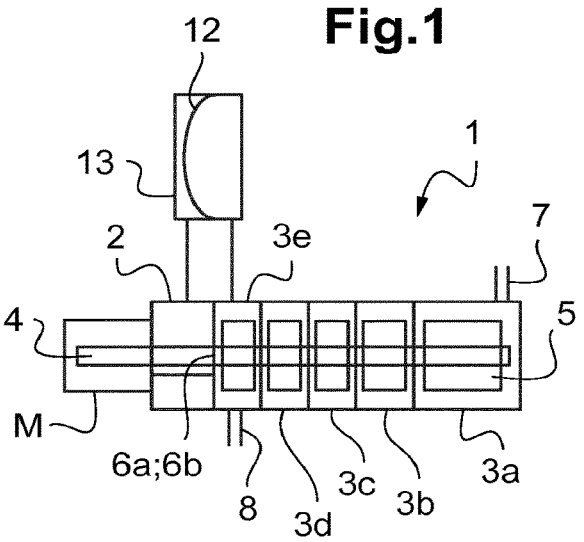
Fig.3
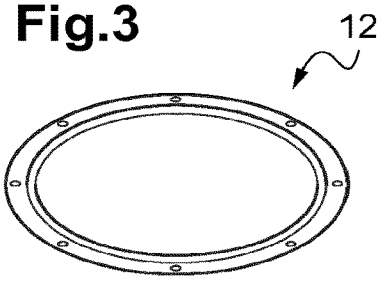
Fig.4
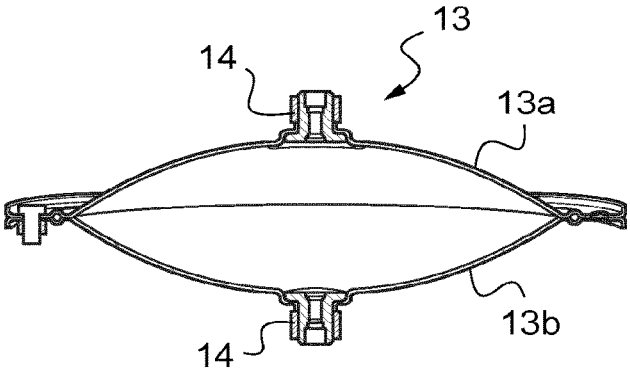
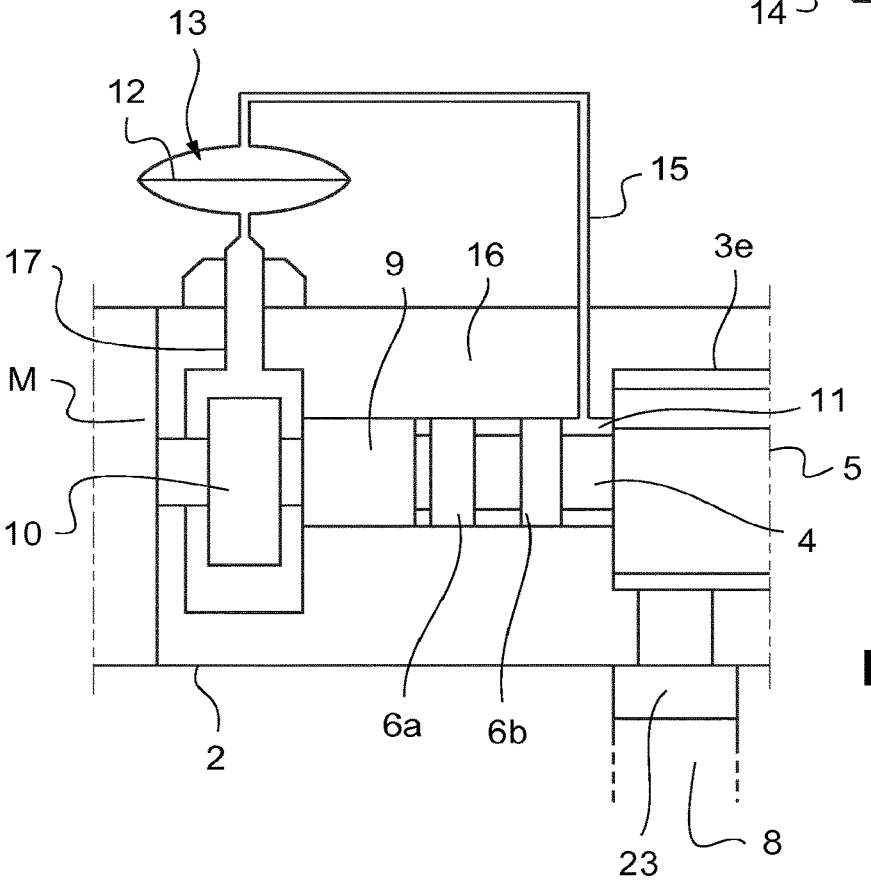
Fig.2

DRY VACUUM PUMP WITH A PRESSURE VARIATION REDUCING EXPANSION DEVICE BETWEEN A PUMPING SIDE VOLUME AND AN OIL SUMP

The present invention relates to a dry vacuum pump such as a "Roots" or "Claw" or screw type pump. More specifically, the invention relates to the lubricant impermeability of the vacuum pump.

BACKGROUND OF THE INVENTION

Dry rough-vacuum pumps comprise one or more pumping stages in series, in which a gas circulates that is to be pumped between an intake and an outlet. A distinction is made among known rough-vacuum pumps between those with rotary lobes, also known as "Roots" pumps, or those with claws, also known as "Claw" pumps, or even those with screws. Vacuum pumps are also known of the Roots compressor (or "Roots Blower") type that are used upstream of the rough-vacuum pumps to increase the pumping capacity. These vacuum pumps are called "dry" since during operation the rotors rotate inside the stator without any mechanical contact between them or with the stator nor with the presence of any oil type lubricant in the pumping stages.

The rotary shafts are supported by bearings, which are lubricated by oil or by grease, and by gears that allow them to be synchronized. It is essential that no traces of oil or of grease are found in the pumping stage for "dry" applications, such as the methods for manufacturing semiconductor substrates. Therefore, any zone (hereafter called "oil sump") containing lubricants needs to be isolated from the dry pumping section by a sealing means, through which the shafts are still able to rotate.

The sealing means that are used mainly comprise physical barriers such as flanges on roller bearings, contact seals, ejector discs, gas purges, oil traps, such as expansion and condensation chambers, or obstacles, such as labyrinths or baffles. These solutions mainly attempt to block or limit oil migration. However, during operation, the pressures implemented in the vacuum pumps can significantly fluctuate and generate drive forces between the lubricated bearings and the pumping stages that are likely to carry particulate pollutants towards the oil sump or oil mist or vapours or grease towards the pumping stage.

BRIEF SUMMARY OF THE INVENTION

Therefore, the aim of the present invention is to propose a dry vacuum pump with improved lubricant impermeability between the pumping stage and the oil sump compared to the prior art.

To this end, the aim of the invention is a dry vacuum pump comprising:

- at least one oil sump;
- at least one pumping stage;
- two rotary shafts respectively supporting at least one rotor extending into the at least one pumping stage, the rotors being configured to rotate in a synchronized manner in the reverse direction in order to convey a gas to be pumped between an intake and an outlet of the vacuum pump, the shafts being supported by bearings lubricated by a lubricant contained in the at least one oil sump; and
- at least one lubricant sealing device interposed between the at least one oil sump and a pumping stage at each shaft passage, characterized in that the vacuum pump further comprises at least one expansion device configured to reduce the pressure variations between a pumping side volume and the at least one oil sump.

The expansion device is mainly based on an operating principle similar to the expansion vessels of heating circuits. It allows pressure variations to be absorbed by variations in volume as a result of the ideal gas law PV=nRT.

This balancing of the pressures between the oil sump and the pumping side volume enables reduction, or even elimination, of the drive forces involved in migrating lubricants towards the pumping stage and particulate pollutants towards the at least one oil sump. It is thus possible to improve the lubricant impermeability in the pumping stages, limit the pollution of the sump oil and reduce oil consumption. Furthermore, when the sealing devices comprise contact seals, the reduction in the pressure differences on both sides of the sealing devices allows the forces exerted on these seals to be reduced and therefore allows their lifetime to be increased.

The vacuum pump is, for example, a rotary lobe rough-vacuum pump, such as a pump of the "Roots" type, or is a "Blower" type (also called Roots compressor) or a "Claw" or screw type vacuum pump.

The vacuum pump can comprise a single oil sump.

This oil sump can be arranged next to the pumping stage, called low-pressure stage, or next to the pumping stage, called high-pressure stage, in the case of a multi-stage vacuum pump. On the other side, the bearings can be lubricated by grease.

The vacuum pump can also comprise two oil sumps. These oil sumps are arranged at a respective end of the vacuum pump, i.e. on the one hand, next to the high-pressure stage and next to the low-pressure stage in the case of a multi-stage vacuum pump. In the case of a single-stage vacuum pump, such as a Roots compressor type vacuum pump (called "Roots Blower"), the oil sumps are arranged on both sides of the single pumping stage.

The sealing devices create a very low conductance around the rotary shafts that significantly limits the passage of lubricating fluids from the oil sump towards the at least one dry pumping stage, whilst allowing the shafts to rotate.

The sealing device comprises for example a seal, which can be, for example, a labyrinth seal, a contact seal, called lip seal, or a baffle or a combination of these embodiments. The vacuum pump comprises, for example, at least one first and one second sealing device, such as contact seals arranged in series on each shaft between the oil sump and the pumping stage.

The pressure prevailing in the oil sump is the atmospheric pressure, for example. The oil sump may or may not communicate with the external atmosphere, for example, via an opening, or may be hermetically sealed from the external atmosphere.

Said pumping stage is configured, for example, to discharge the pumped gases at atmospheric pressure. In the case of a multi-stage pump, said pumping stage also can be the first pumping stage (called "low-pressure" stage).

The expansion device comprises, for example, at least one deformable and gas-tight membrane. The expansion device comprises, for example, a single membrane for a shaft passage or a plurality of membranes arranged in parallel.

The shape and the material of the membrane can be considered on the basis of the volumes to be varied on both sides of the membrane during various pumping phases, temperatures and operations of the vacuum pump, as well as on the basis of the available space.

The at least one membrane is an elastomer material, for example, such as "NBR" (or "acrylonitrile-butadiene copolymer") or Viton® (or "fluorocarbon rubber"). These materials allow the desired volume deformations to be produced, are impermeable at the considered pressures, withstand the pumped gases and the high temperatures and withstand a significant number of deformations without any performance losses. The membrane can comprise protective coatings, inserts and/or impregnated reinforcing fabrics, such as woven and knitted fabrics, in order to prevent the membrane from tearing.

The at least one membrane has, for example, the general shape of a disc or of a bowl in the rest position.

The at least one membrane is mounted, for example, in a rigid protective shell.

According to a first embodiment, the expansion device is interposed between, on the one hand, the pumping side volume and, on the other hand, the oil sump volume. The pumping side volume is located between the at least one sealing device and the pumping stage.

For example, more specifically, the pumping side volume is located between the at least one sealing device and an output of the pumping stage located downstream of the rotors, considering the flow direction of the pumped gases in the vacuum pump and considering the oil sump to be located on the discharge side of the vacuum pump.

During operation, the pumping side and oil sump volumes can vary through expansion when pressure differences occur on both sides of the expansion device. These variations in volume allow the pressures to be balanced between the pumping stage and the oil sump.

According to a second embodiment, the pumping stage adjoining the oil sump is configured to discharge the pumped gases at atmospheric pressure. Therefore, the vacuum pump is a rough-vacuum pump.

The pressure prevailing in the oil sump is the atmospheric pressure.

The expansion device separates the pumping side volume from the external atmosphere. The pumping side volume is particularly interposed between an output of the pumping stage and the at least one sealing device. The output of the pumping stage is located downstream of the rotors considering the direction of flow of the pumped gases in the vacuum pump.

During operation, the pumping side volume can vary when pressure differences occur between the pumping side volume and the external atmosphere, which allows the pressure output from the pumping stage to be balanced with the atmospheric pressure and thus with the pressure prevailing in the oil sump.

According to a third embodiment, the expansion device separates the oil sump volume from a pumping side volume interposed between a first and a second sealing device arranged in series on each shaft. During operation, the variations in the pumping side and oil sump volumes allow the pressures to be balanced between the pumping side volume interposed between the sealing devices and the oil sump. The pressure variations that can occur at the output of the pumping stage are only moderately transferred to the pumping side and oil sump volumes. Possible inversions of the pressure deviations between the pumping side volume and the oil sump volume are avoided.

According to a fourth embodiment, in which the pumping stage is configured to discharge the pumped gases at atmospheric pressure and the pressure prevailing in the oil sump is the atmospheric pressure, the expansion device separates the pumping side volume, interposed between a first and a second sealing device arranged in series on each shaft, from the external atmosphere. During operation, the pumping side volume interposed between the two sealing devices can vary when pressure differences occur between the pumping side volume and the external atmosphere, which allows the pressure of the pumping side volume to be balanced with the atmospheric pressure and thus with the pressure prevailing in the oil sump.

BRIEF DESCRIPTION OF THE DRAWINGS

Further advantages and features will become apparent upon reading the description of the invention, as well as with reference to the accompanying drawings, in which:

FIG. 1 shows a highly schematic view of a vacuum pump according to a first embodiment;

FIG. 2 shows a section view of details of the vacuum pump of FIG. 1;

FIG. 3 shows a perspective view of a membrane of an expansion device according to a first embodiment;

FIG. 4 shows a section view of a rigid protective shell for the membrane of FIG. 3;

Throughout these figures, identical elements use the same reference numbers.

DETAILED DESCRIPTION OF THE INVENTION

Figure 5:
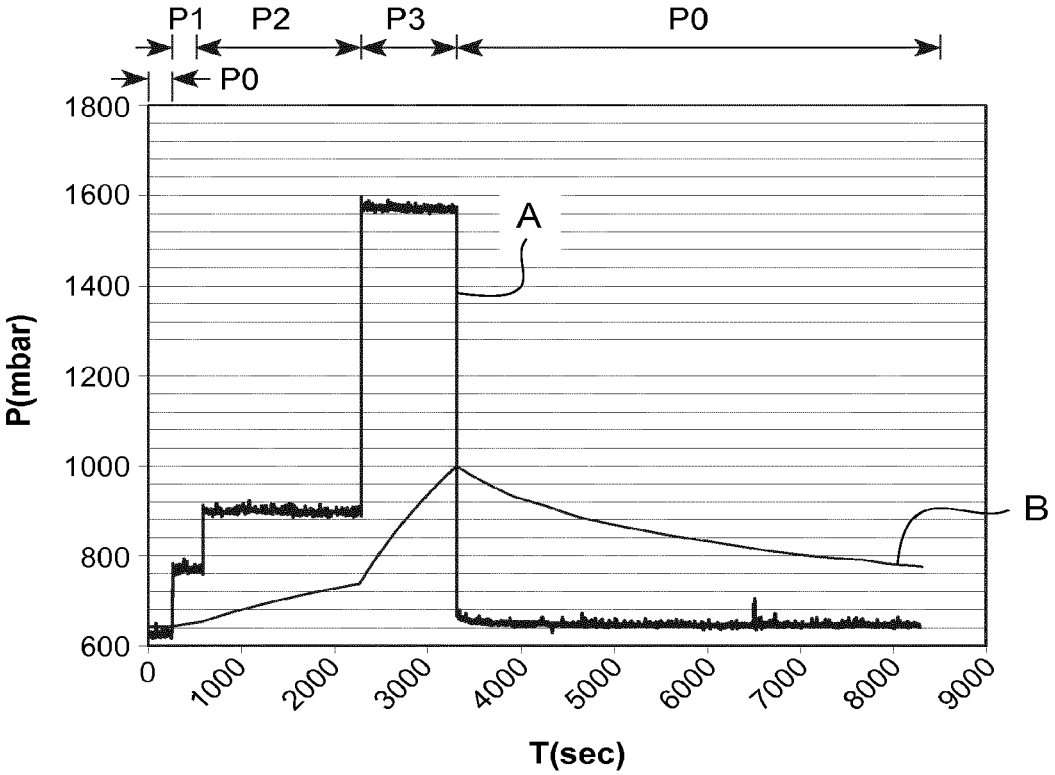
FIG. 5 is a graph showing the pressure (in mbar) prevailing at the output of the pumping stage (curve A) and the pressure (in mbar) prevailing in the oil sump (curve B) for a vacuum pump of the prior art as a function of time (in seconds) and for different intake pressures (in mbar)

The following embodiments are examples. Even though the description refers to one or more embodiments, this does not necessarily mean that each reference relates to the same embodiment, or that the features only apply to a single embodiment. Simple features of various embodiments also can be combined or interchanged in order to provide other embodiments.

FIG. 1 shows a dry vacuum pump 1 according to a first embodiment.

The vacuum pump 1 comprises at least one oil sump 2, two rotary shafts 4 and at least one first lubricant sealing device 6*a*, 6*b* interposed between the at least one oil sump 2 and a pumping stage 3*e* at the shaft passages between the at least one oil sump 2 and the pumping stage 3*e*.

The shafts 4 respectively support at least one rotor 5 extending into the pumping stage 3*e* in order to convey a gas to be pumped between an intake 7 and an outlet 8 of the vacuum pump 1.

In the illustrative example, the vacuum pump 1 comprises a plurality of pumping stages 3*a*, 3*b*, 3*c*, 3*d*, 3*e*, such as five stages, mounted in series between the intake 7 and the outlet 8 and in which a gas to be pumped can circulate.

The pumping stage 3*e* adjoining the sealing device 6*a*, 6*b* can be one of the two end pumping stages of the vacuum pump 1, i.e. the first pumping stage 3*a* (called "low-pressure" stage) or the final pumping stage 3*e* (called "high-pressure" stage), configured to discharge the pumped gases at atmospheric pressure. In the example, the considered pumping stage 3*e* is that which is configured to discharge the pumped gases at atmospheric pressure.

Each pumping stage 3*a*, 3*b*, 3*c*, 3*d*, 3*e* comprises a respective input and output. The successive pumping stages 3*a*-3*e* are connected in series one after the other by respective inter-stage channels connecting the output of the previous pumping stage to the input of the next stage.

The rotors 5 have, for example, lobes with identical profiles, for example, of the "Roots" type (section in the shape of a number "8" or of a "bean") or of the "Claw" type or are of the screw type or of another similar volumetric vacuum pump principle. The rotors 5, particularly with lobes with identical profiles, are angularly offset and are driven to rotate in a synchronized manner in the reverse direction in each stage. During rotation, the gas drawn from the input is captured in the volume generated by the rotors and the stator, and is then conveyed by the rotors towards the next stage.

The vacuum pump 1 is, for example, a rough-vacuum pump, with the discharge pressure of the vacuum pump 1 then being the atmospheric pressure. According to another embodiment, the vacuum pump 1 is a Roots pump, called "Roots compressor" ("Roots Blower") that is used in series and upstream of a rough-vacuum pump.

The vacuum pump 1 can also comprise a non-return valve 23 (see FIG. 2) at the output of the final pumping stage 3*e*, upstream of the outlet 8, in order to prevent pumped gases from returning in the pumping stage 3*e*.

The shafts 4 are driven, for example, on the outlet side 8, by a motor M of the vacuum pump 1. They are supported by bearings lubricated by a lubricant contained in the oil sump 2. As is more specifically shown in FIG. 2, the lubricant, such as grease or oil, particularly allows the roller bearings 9 of the bearings and the gears 10 to be lubricated.

The pressure prevailing in the oil sump 2 is the atmospheric pressure, for example. The oil sump 2 may or may not communicate with the external atmosphere.

The sealing device 6*a*, 6*b* creates a very low conductance around the rotary shafts 4 that significantly limits the passage of lubricating fluids from the sump 2 towards the dry pumping stages 3*a*-3*e*, whilst allowing the shafts 4 to rotate.

The sealing device 6*a*, 6*b* comprises a seal, for example, which can be a labyrinth seal, a contact seal, called lip seal, or a baffle or a combination of these embodiments. The vacuum pump 1 comprises, for example, at least one first and one second sealing device 6*a*, 6*b*, such as contact seals arranged in series on each shaft 4.

The vacuum pump 1 further comprises at least one expansion device 12 configured to reduce the pressure variations between a pumping side volume 11 and the oil sump 2.

The expansion device 12 comprises, for example, a deformable and gas-tight membrane. The expansion device 12 comprises, for example, a single membrane at a shaft passage or a plurality of membranes arranged in parallel.

The shape and the material of the membrane can be considered on the basis of the volumes to be varied on both sides of the membrane during various pumping phases, temperatures and operations of the vacuum pump 1, as well as on the basis of the available space.

The membrane is an elastomer material, for example, such as "NBR" (or "acrylonitrile-butadiene copolymer") or Viton® (or "fluorocarbon rubber"). These materials allow the desired volume deformations to be produced, such as deformations of approximately 500 $cm^3$, are impermeable at the pressures that are involved, withstand the pumped gases, such as the process gases, and the high temperatures, for example, of approximately 100° C., and withstand a significant number of deformations without any performance losses. The membrane can comprise protective coatings, inserts and/or impregnated reinforcing fabrics, such as woven and knitted fabrics, in order to prevent the membrane from tearing.

The membrane has, for example, the general shape of a disc or of a bowl in the rest position (FIG. 3). In the case of a single membrane, the surface is greater than 150 $cm^2$, for example. The diameter of a disc-shaped membrane is greater than 75 mm, for example.

The membrane is mounted, for example, in a rigid protective shell 13 (FIG. 4). The rigid protective shell 13 is formed, for example, by two half-shells 13*a*, 13*b*, in the form of domes, for example, and having annular assembly edges, for example. The half-shells 13*a*, 13*b* are fixed together at the circular ends thereof by sealably sandwiching the periphery of the disc of the membrane. The half-shells 13*a*, 13*b* have one respective orifice 14.

In the first embodiment shown in FIG. 2, the expansion device 12 is interposed between, on the one hand, the pumping side volume 11 located between the at least one sealing device 6*a*, 6*b* and the pumping stage 3*e* and, on the other hand, the oil sump 2 volume.

More specifically, the pumping side volume 11 is located between the at least one sealing device 6*a*, 6*b* and an output of the pumping stage located downstream of the rotors 5, considering the flow direction of the pumped gases in the vacuum pump 1 and the case whereby the oil sump 2 is located on the discharge side of the vacuum pump 1.

According to one embodiment, a first branch 15, produced in the pump body 16, emerges in the pumping side volume 11 located at the output of the pumping stage 3*e*, downstream of the passage of the rotors 5, between the sealing device 6*b* and the non-return valve 23. This first branch 15 is connected to a first orifice 14 of the rigid protective shell 13 of the membrane of the expansion device 12.

A second branch 17, produced in the pump body 16, emerges in the oil sump 2 volume, for example, in the upper part of the oil sump 2. This second branch 17 is connected to the second orifice 14 of the shell 13, with the first and the second orifice 14 being arranged on both sides of the membrane of the expansion device 12.

Thus, a first side of the membrane communicates with the pumping side volume 11 and a second side of the membrane communicates with the upper part of the oil sump 2. The volumes on both sides of the sealing devices 6*a*, 6*b*, on the oil sump 2 side and on the pumping 11 side, are thus connected whilst being separated by an impermeable and deformable membrane, which is located in a shell 13, which is also impermeable to the outside, with the pressure variations resulting in a deformation of the membrane.

During operation, the membrane can deform when pressure differences occur on both sides of the membrane. These deformations result in variations in the pumping side 11 and oil sump 2 volumes and these variations in the volumes allow the pressures between the output of the pumping stage 3*e* and the oil sump 2 to be balanced.

Figure 6:
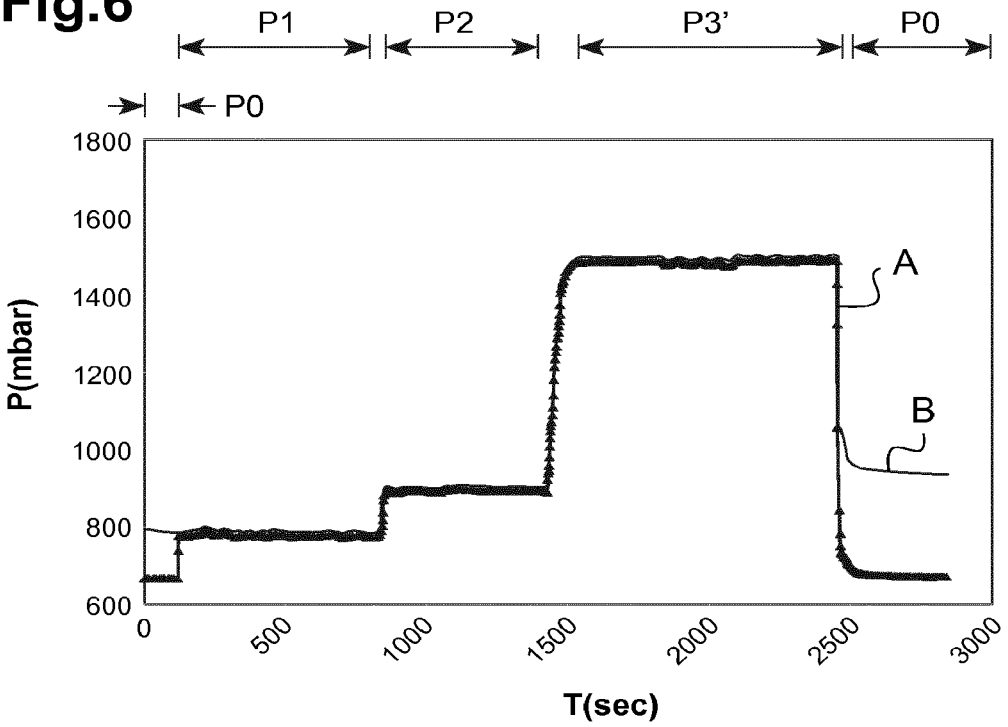
FIG. 6 is a graph showing the pressure (in mbar) prevailing at the output of the pumping stage (curve A) and the pressure (in mbar) prevailing in the oil sump (curve B) for a vacuum pump according to the first embodiment of the invention as a function of time (in seconds) and for different intake pressures.

This can be more easily understood with reference to the graphs of FIGS. 5 and 6 of a vacuum pump of the prior art (FIG. 5) and of a vacuum pump 1 according to the invention (FIG. 6).

These graphs show pressure curves in the pumping side volume 11 at the output of the pumping stage 3*e* (curve A) and in the oil sump 2 (curve B) as a function of time and for different intake pressures (P0 is the pressure obtained for ultimate vacuum pumping, P1=10 mbars, P2=100 mbars, P3 is the ambient atmospheric pressure).

On the graph of the prior art (FIG. 5), significant pressure differences can be seen between the pressure at the output of the pumping stage 3*e* (curve A) and the pressure in the oil sump 2 (curve B). It is these pressure differences and the inversions of these pressure differences that can generate drive forces between the oil sump 2 and the pumping stage 3*e* that are likely to carry particulate pollutants towards the oil sump 2 or mist or oil vapours or grease towards the pumping stage 3*e*.

However, on the graph of FIG. 6, for a vacuum pump 1 according to the invention, it can be seen that the pressure curves A and B in the pumping side volume 11 and in the oil sump 2 are coincident for most of the intake pressure values. This balancing of the pressures enables reduction, or even elimination, of the drive forces involved in migrating lubricants towards the pumping stage 3*e* and particulate pollutants towards the oil sump 2. Thus, lubricant impermeability is improved in the pumping stages 3*a*-3*e*. Furthermore, pollution of the oil of the sump 2 is limited and oil consumption is reduced. Moreover, when the sealing device 6*a*, 6*b* comprises contact seals, the reduction in the pressure differences on both sides of the sealing device 6*a*, 6*b* allows a reduction in the forces exerted on these seals and thus allows the lifetime of the sealing device 6*a*, 6*b* to be increased.

Figure 7:
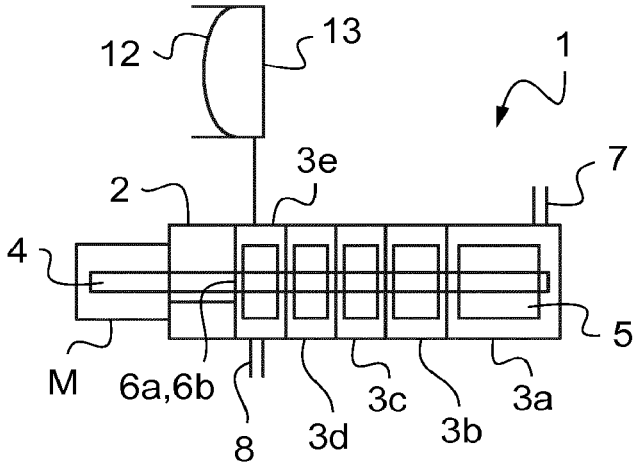
FIG. 7 shows a highly schematic view of a vacuum pump according to a second embodiment.
Figure 8:
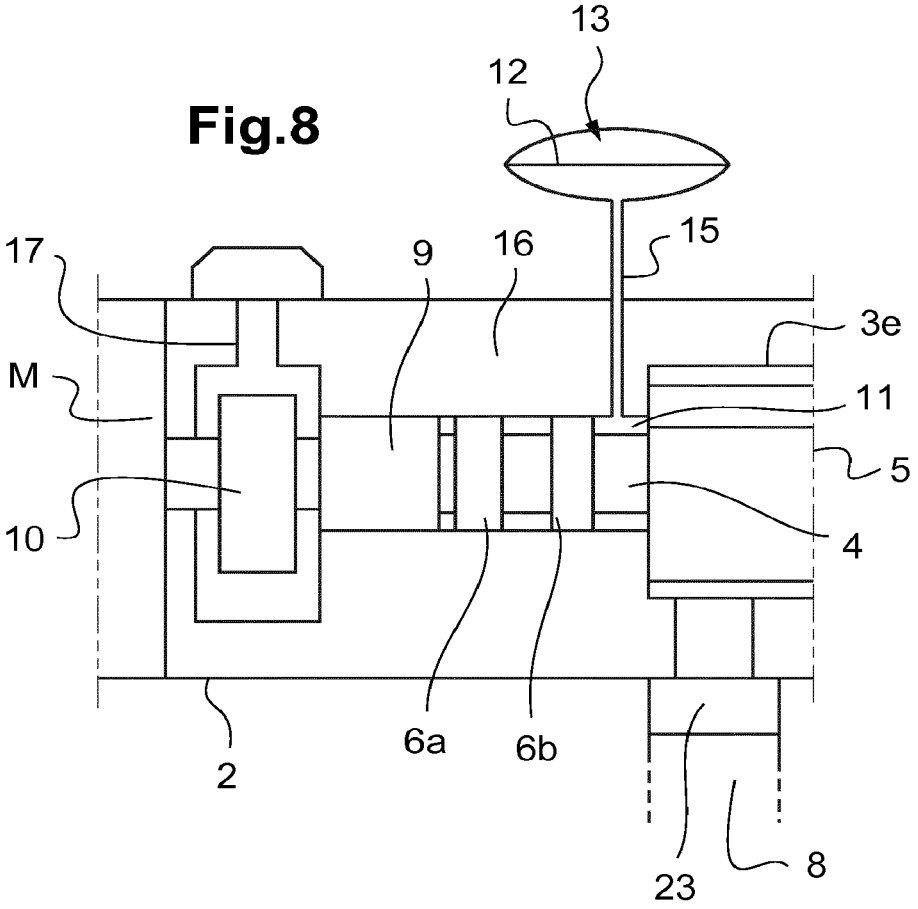
FIG. 8 shows a section view of details of the vacuum pump of FIG. 7.

FIGS. 7 and 8 show a second embodiment, in which the vacuum pump 1 is of the rough-vacuum pump type.

In this embodiment, the expansion device 12 directly separates the pumping side volume 11, interposed between an output of the pumping stage 3*e* and the at least one sealing device 6*b*, from the external atmosphere. The pressure prevailing in the oil sump 2 is the atmospheric pressure and the pumping stage 3*e* is configured to discharge the pumped gases at atmospheric pressure downstream of the non-return valve 23.

More specifically, according to an embodiment shown in FIG. 8, a first branch 15, produced in the pump body 16, emerges in the pumping side volume 11 located between the rotors 5 of the pumping stage 3*e*, the sealing device 6*b* and the non-return valve 23. This first branch 15 is connected to a first orifice 14 of the rigid protective shell 13 of the membrane of the expansion device 12. The second orifice 14 of the shell 13 is left open.

During operation, the membrane can deform when pressure differences occur on both sides of the membrane, between the pumping side volume 11 and the external atmosphere. These deformations result in variations in the pumping side volume 11 at the output of the pumping stage 3*e*, which allows the pressure at the output of the pumping stage 3*e* to be balanced with the atmospheric pressure and thus with the pressure prevailing in the oil sump 2.

Figure 9:
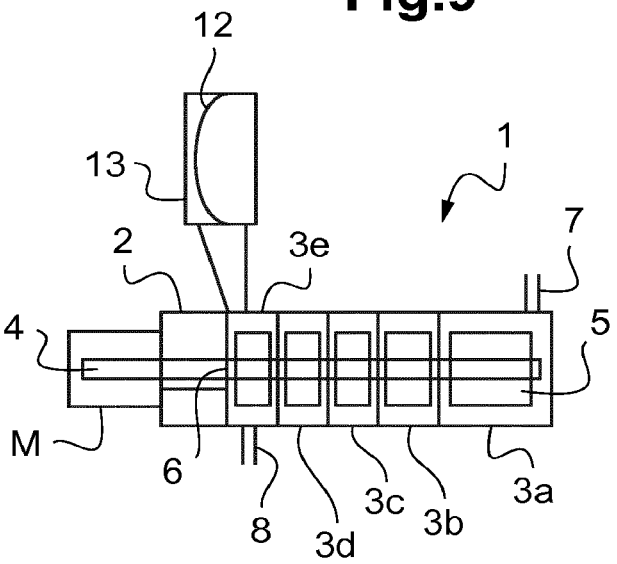
FIG. 9 shows a highly schematic view of a vacuum pump according to a third embodiment.
Figure 10:
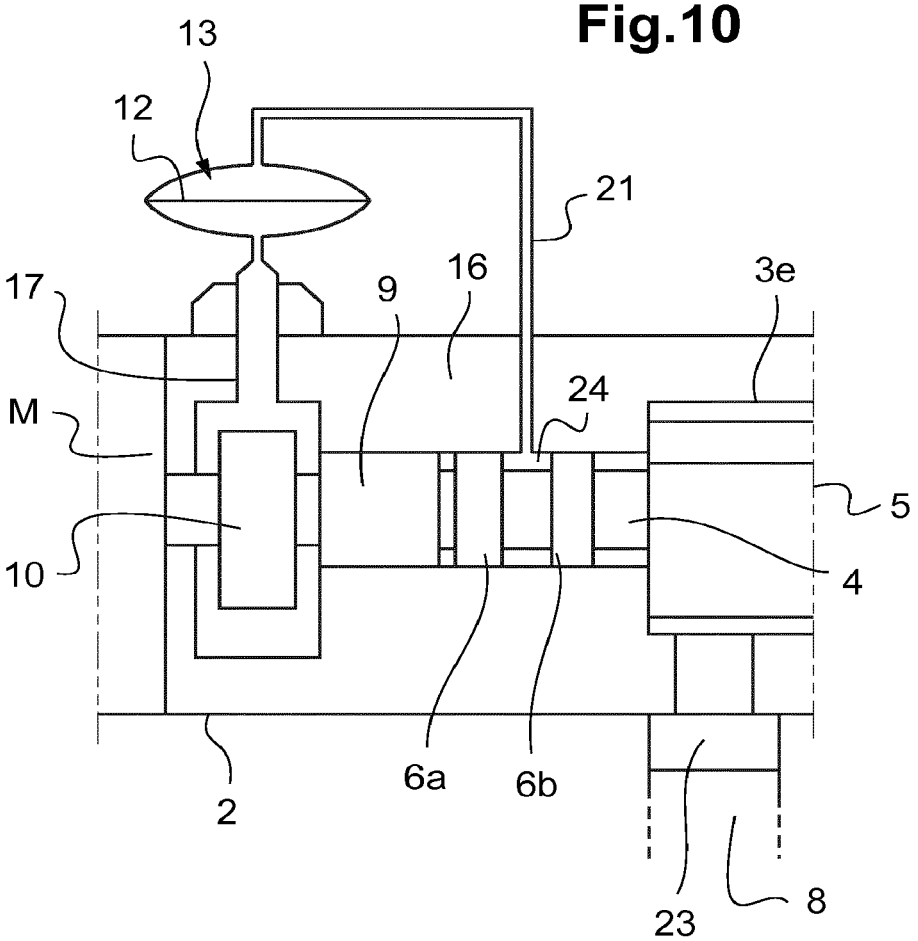
FIG. 10 shows a section view of details of the vacuum pump of FIG. 9.

FIGS. 9 and 10 show a third embodiment of the vacuum pump 1.

In this embodiment, the membrane of the expansion device 12 separates the oil sump 2 volume from a pumping side volume 24 interposed between the first and the second sealing devices 6*a*, 6*b* arranged in series on the shaft 4.

More specifically, according to an embodiment shown in FIG. 10, a first branch 21, produced in the pump body 16, emerges between the sealing devices 6*a*, 6*b*. This first branch 21 is connected to a first orifice 14 of the rigid protective shell 13 of the membrane of the expansion device 12.

A second branch 17, produced in the pump body 16, emerges in the oil sump 2 volume, for example, in the upper part of the oil sump 2. This second branch 17 is connected to the second orifice 14 of the shell 13, with the first and the second orifice 14 being arranged on both sides of the membrane of the expansion device 12.

Thus, a first side of the membrane communicates with the first branch 21 emerging in a pumping side volume 24 located between the sealing devices 6*a*, 6*b* and a second side of the membrane communicates with the upper part of the oil sump 2.

During operation, the membrane can deform when pressure differences occur on both sides of the membrane, between the pumping side volume 24 and the oil sump 2 volume. These deformations allow the pressure between the pumping side volume 24 located between the sealing devices 6*a*, 6*b* and the pressure prevailing in the oil sump 2 to be balanced.

Figure 11:
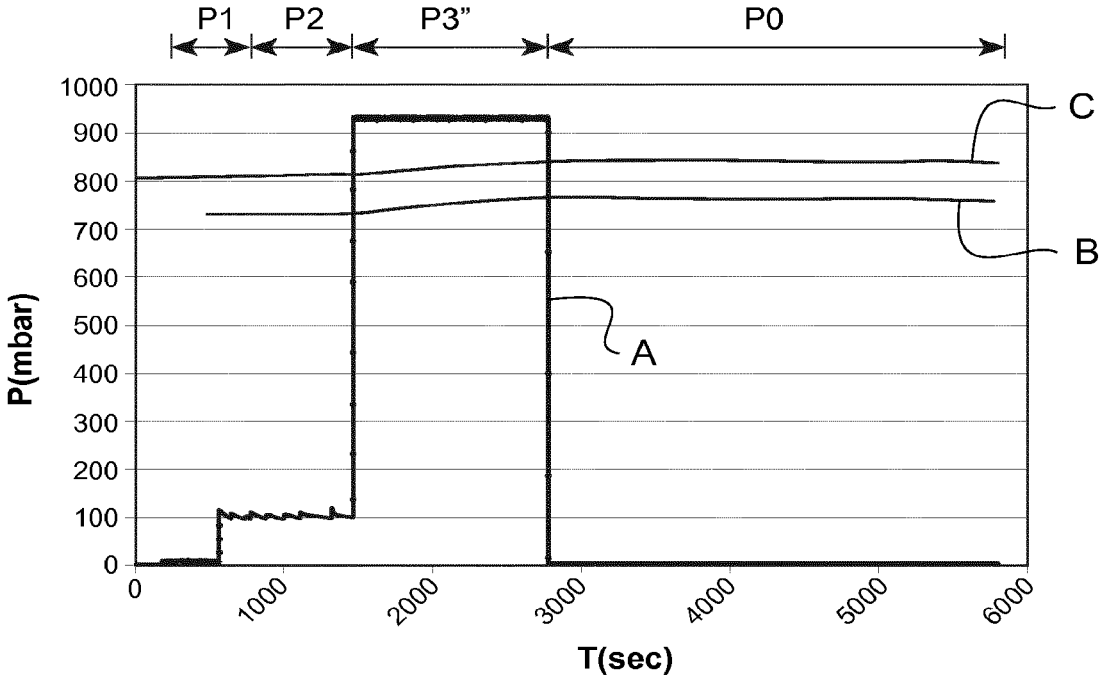
FIG. 11 is a graph showing the pressure (in mbar) prevailing at the output of the pumping stage (curve A), the pressure (in mbar) prevailing in the oil sump (curve B) and the pressure (in mbar) prevailing in the pumping side volume located between two lubricant sealing devices (curve C) for a vacuum pump according to a third embodiment of the invention, as a function of time (in seconds) and for different intake pressures.

As can be seen in the graph of FIG. 11, despite the significant pressure variations that can occur at the output of the pumping stage 3*e* (curve A), the pressure differences remain substantially constant between the pumping side 24 and oil sump 2 volumes (curves B and C) due to the variations in the volumes. Possible inversions of the pressure deviations are avoided between the pumping side volume 24 and the oil sump 2 volume.

Figure 12:
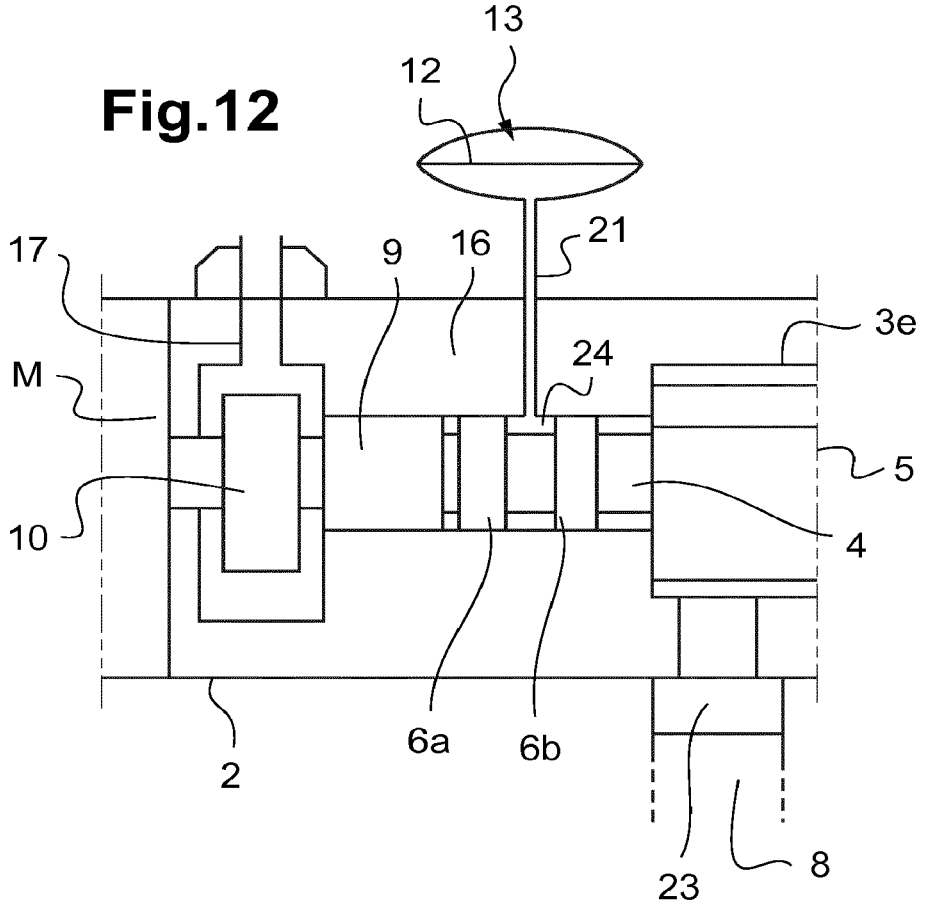
FIG. 12 shows a section view of details of a vacuum pump according to a fourth embodiment.

FIG. 12 shows a fourth embodiment of the vacuum pump 1.

In this embodiment, the membrane of the expansion device 12 directly separates the pumping side volume 24, interposed between the first and the second sealing devices 6*a*, 6*b*, from the external atmosphere. The pressure prevailing in the oil sump 2 is the atmospheric pressure and the pumping stage 3*e* is configured to discharge the pumped gases at atmospheric pressure.

More specifically, according to an embodiment shown in FIG. 12, a first branch 21, produced in the pump body 16, emerges between the sealing devices 6*a*, 6*b*. This first branch 21 is connected to a first orifice 14 of the rigid protective shell 13 of the membrane. The second orifice 14 of the shell 13 is left open.

During operation, the membrane can deform when pressure differences occur on both sides of the membrane, between the pumping side volume 24 and the external atmosphere. These deformations result in variations in the pumping side volume 24 interposed between the two sealing devices 6*a*, 6*b*, which allows the pressure of the pumping side volume 24 to be balanced with the atmospheric pressure and thus with the pressure prevailing in the oil sump 2.

Even though the embodiments of FIGS. 1 to 12 show a membrane having a general disc shape, other shapes are conceivable.

It is also conceivable for the expansion device 12 not to be located outside the body 16 of the vacuum pump 1, for example, by arranging at least one membrane in a wall of the oil sump 2 volume, with one side of the membrane being connected to the oil sump 2 volume, the other side being connected to a channel arranged in the pump body 16 and emerging in the pumping side volume 11 or 24.

The invention claimed is:

1. A vacuum pump comprising:

at least one oil sump;

at least one pumping stage;

two rotary shafts respectively supporting at least one rotor extending into the at least one pumping stage, the at least one rotor located on the respective two rotary shafts being configured to rotate in a synchronized manner in the reverse direction in order to convey a gas to be pumped between an intake and an outlet of the vacuum pump, the two rotary shafts being supported by bearings lubricated by a lubricant contained in the at least one oil sump; and at least one lubricant sealing device interposed between the at least one oil sump and the at least one pumping stage at each shaft passage, wherein the vacuum pump further comprises at least one expansion device configured to reduce the pressure variations between a pumping side volume and the at least one oil sump.

2. The vacuum pump according to claim 1, wherein the at least one pumping stage is configured to discharge the pumped gases at atmospheric pressure.

3. The vacuum pump according to claim 2, wherein the at least one expansion device separates the pumping side volume from the external atmosphere, the pressure prevailing in the at least one oil sump being the atmospheric pressure.

4. The vacuum pump according to claim 3, wherein the pumping side volume is interposed between an output of the at least one pumping stage and the at least one lubricant sealing device.

5. The vacuum pump according to claim 3, wherein the at least one lubricant sealing device comprises a first and a second sealing device, and the pumping side volume is interposed between the first and the second sealing device arranged in series on each shaft of the two rotary shafts.

6. The vacuum pump according to claim 1, wherein the at least one expansion device is interposed between the pumping side volume located between the at least one lubricant sealing device and the at least one pumping stage and the oil sump volume of the at least one oil sump.

7. The vacuum pump according to claim 1, wherein the at least one lubricant sealing device comprises a first and a second sealing device, and the at least one expansion device separates the oil sump volume of the at least one oil sump from a pumping side volume interposed between the first and the second sealing device arranged in series on each shaft of the two rotary shafts.

8. The vacuum pump according to claim 1, wherein the at least one expansion device comprises at least one deformable and gas-tight membrane having substantially a shape of a disc or of a bowl in the rest position.

9. The vacuum pump according to claim 8, wherein the at least one deformable and gas-tight membrane is mounted in a rigid protective shell.

10. The vacuum pump according to claim 8, wherein the at least one deformable and gas-tight membrane is made of elastomer material.

11. The vacuum pump according to claim 1, further comprising the at least one lubricant sealing device comprises at least one first and one second sealing device arranged in series on each shaft of the two rotary shafts.

* * * * *